United States Patent [19]

Hachiga et al.

[11] 4,366,794

[45] Jan. 4, 1983

[54] FUEL INJECTION CONTROL METHOD FOR INTERNAL COMBUSTION ENGINES

[75] Inventors: Takasi Hachiga, Kariya; Kazuyoshi Tamaki, Nagoya; Jiro Nakano, Okazaki; Hironobu Ono, Toyota, all of Japan

[73] Assignees: Nippondenso Co., Ltd., Kariya; Toyota Jidosha Kogyo Kabushiki Kaisha, Toyota, both of Japan

[21] Appl. No.: 251,704

[22] Filed: Apr. 6, 1981

[30] Foreign Application Priority Data

Apr. 8, 1980 [JP] Japan ..... 55-46596

[51] Int. Cl.[3] ..... F02D 17/00

[52] U.S. Cl. ..... 123/479; 123/198 D; 123/198 DB

[58] Field of Search ..... 123/478, 479, 480, 481, 123/198 DB, 198 F, 198 D; 60/276, 277, 285

[56] References Cited

U.S. PATENT DOCUMENTS

| | | | |
|---|---|---|---|
| 4,006,718 | 2/1977 | Konomi | 123/479 X |
| 4,024,850 | 5/1977 | Peter et al. | 60/277 X |
| 4,117,807 | 10/1978 | Barnard | 123/478 |

*Primary Examiner*—Tony M. Argenbright

*Attorney, Agent, or Firm*—Cushman, Darby & Cushamn

[57] ABSTRACT

In a method of computing and controlling the fuel injection quantity of a fuel injection system and the ignition timing of an ignition system of an international combustion engine by a microcomputer in accordance with operating conditions of the engine, a discrimination signal indicative of the presence or absence of misfiring is generated in accordance with an electric signal from the ignition system so that when misfiring occurs, even if fuel injection quantity data has already been computed, data for reducing the fuel injection quantity to zero is generated in response to the discrimination signal to stop fuel injection.

4 Claims, 3 Drawing Figures

FUEL INJECTION CONTROL METHOD FOR INTERNAL COMBUSTION ENGINES

BACKGROUND OF THE INVENTION

The present invention relates to a control method in which the quantity of fuel supplied by the injection through the electromagnetically operated fuel injection valves of a fuel injection system of an internal combustion engine and the timing of ignition of an ignition system are electronically computed and controlled by a microcomputer, and more particularly to a control method designed such that the injection of fuel is stopped when the ignition system misfires.

DESCRIPTION OF THE PRIOR ART

A conventional control method of the above-mentioned type is so designed that the quantity of fuel injection and the timing of ignition are controlled by using in common crank angle signals as engine rotation information and an intake air quantity signal. However, such a conventional method is disadvantageous in that the control of fuel injection is accomplished in accordance with a computation made in response to the crank angle signals irrespective of the presence or absence of any irregularity occurring in the ignition system so that despite the presence of a failure in a component of the ignition system such as an ignition coil drive circuit, that is, misfiring, the fuel supply by the injection is continued thereby to cause such troubles as afterburning, a rise in the catalyst temperature, etc.

SUMMARY OF THE INVENTION

The present invention has been made to overcome the foregoing deficiencies in the prior art.

It is therefore the object of this invention to provide an improved control method in which the fuel injection quantity of a fuel injection system and the ignition timing of an ignition system of an engine are computed and controlled by a microcomputer in accordance with the operating conditions of the engine. The control method of this invention is characterized by determining the presence or absence of misfiring in response to a signal from an ignition coil of the ignition system and generating, when the result of the determination indicates the presence of misfiring, data for reducing the fuel injection quantity to zero irrespective of computed data of the fuel injection quantity so as to stop fuel injection, thereby positively preventing the occurrence of afterburning, a rise in the catalyst temperature, etc., due to a failure in a component of the ignition system.

BRIEF DESCRIPTION OF THE DRAWINGS

In the drawings, like reference numerals refer to like parts.

DESCRIPTION OF THE PREFERRED EMBODIMENT

The present invention will now be described in greater detail with reference to the illustrated embodiment.

Figure 1:
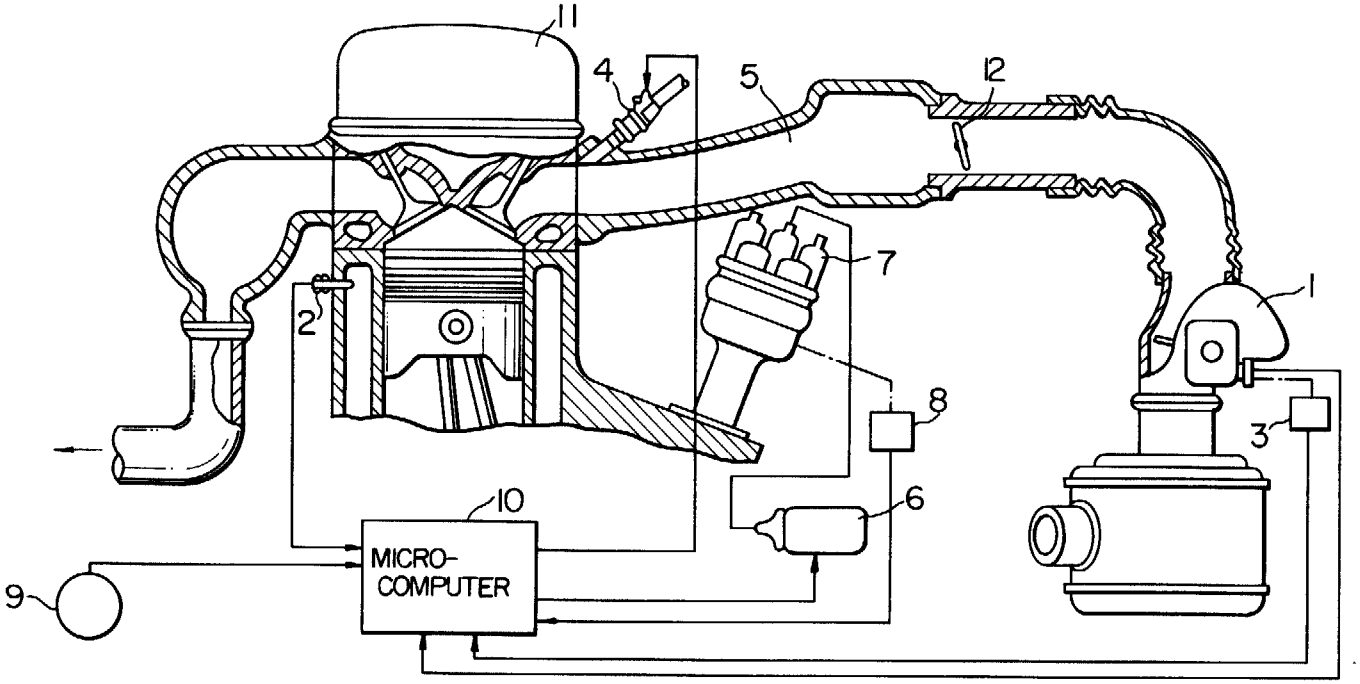
FIG. 1 is a schematic diagram showing the construction of an embodiment of this invention.

Referring to FIG. 1 illustrating the overall construction of an apparatus for performing the method of this invention, numeral 1 designates an air flow sensor for detecting the quantity of air taken into an engine, 2 a water temperature sensor for detecting the temperature of the engine cooling water, 3 an intake air temperature sensor arranged in the air flow sensor 1 for detecting the intake air temperature, and 4 an electromagnetically operated fuel injection valve mounted near an intake port of an intake manifold 5 for each of the cylinders of the engine and designed to deliver fuel under regulated constant fuel pressure. Numeral 6 designates an ignition coil forming a part of the engine ignition system, and 7 a distributor for distributing the ignition energy of the ignition coil 6 to the spark plugs inserted into the respective cylinders. As is well known, the distributor 7 is rotated once for every two revolutions of the engine crankshaft and it contains a rotational angle sensor 8 for detecting the rotational angles of the engine. Numeral 9 designates an operating condition sensor for determining and detecting various operating conditions of the engine. Numeral 10 designates an engine control microcomputer responsive to the signals from the air flow sensor 1, the water temperature sensor 2, the intake air temperature sensor 3, the rotational angle sensor 8 and the operating condition sensor 9 to compute and control the quantity of fuel to be supplied by the injection thereof from the fuel injection valves 4 to the engine and the ignition timing of the engine. Numeral 11 designates an engine body, and 12 an engine throttle valve.

Figure 2:
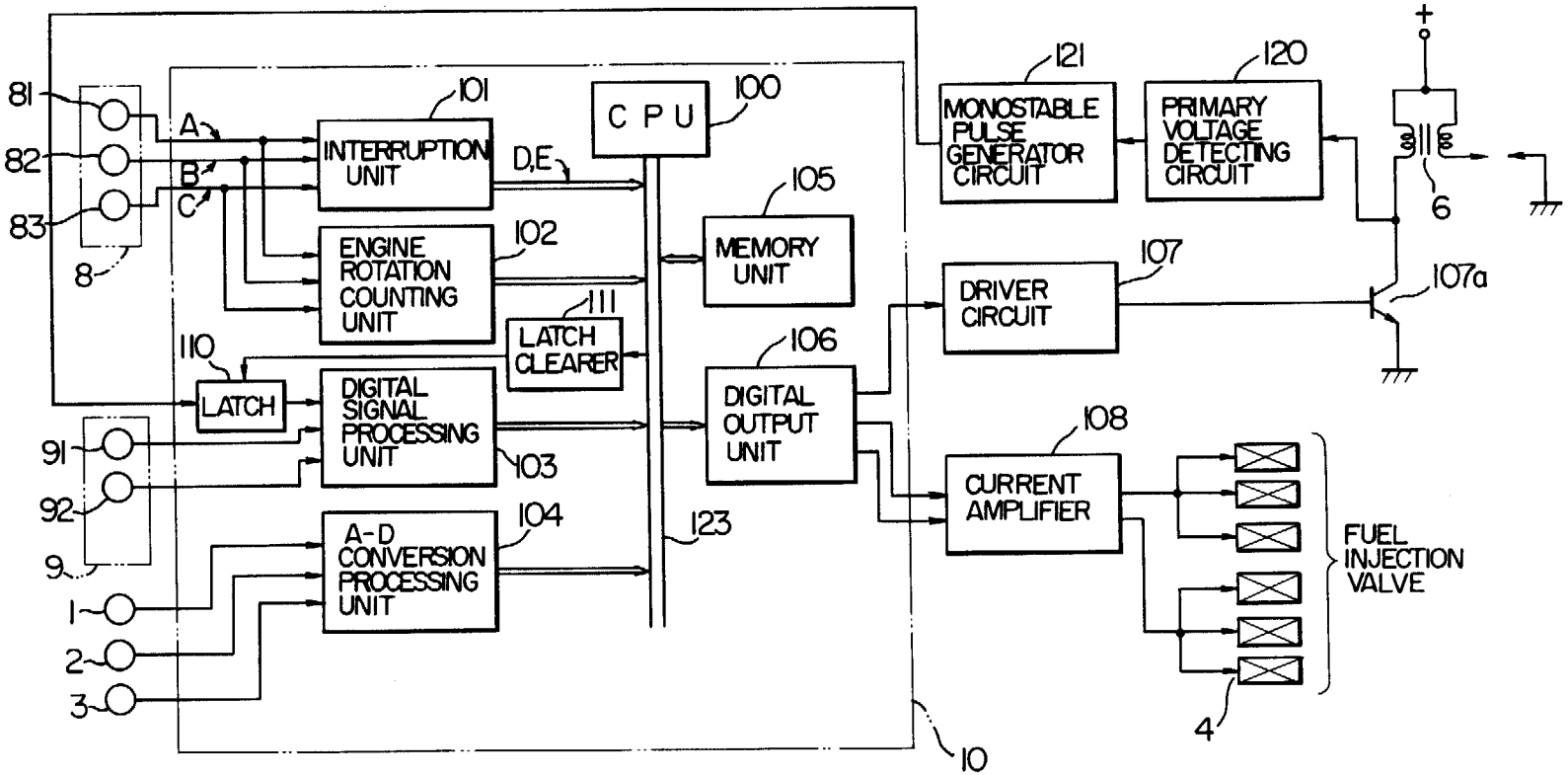
FIG. 2 is a block diagram of the microcomputer shown in FIG. 1.

FIG. 2 is a block diagram for explaining in detail the microcomputer 10, in which numeral 100 designates a microprocessor unit or CPU for computing the fuel injection quantity and the ignition timing. Numeral 101 designates an interruption unit responsive to the rotational angle signals from the rotational angle sensor 8 contained in the distributor 7 to command interruption for the fuel injection quantity processing and the ignition timing processing, and the output information from the interruption unit 101 is transmitted to the CPU 100 via a command bus 123. Numeral 102 designates an engine rotation counting unit which receives the rotational angle signals from the rotational angle sensor 8 and is responsive to the clock signals of a predetermined frequency supplied from the CPU 100 so as to count a period for predetermined rotational angles and compute the engine rotational speed. Numeral 103 designates a digital signal processing unit responsive to the control signals from the CPU 100 to sequentially read the signals from the operating condition sensor 9 and a latch circuit 110 into the CPU 100. The operating condition sensor 9 comprises, for example, a totally closed throttle switch 91 for detecting whether the throttle valve 12 has been closed and a wide opening throttle switch 92 for detecting whether the throttle valve 12 has been opened in excess of a predetermined opening, namely, whether the engine is at a high load operation. Numeral 104 designates an A-D conversion processing unit including an analog multiplexer and having a function of subjecting the signals from the air flow sensor 1, the water temperature sensor 2 and the intake air temperature sensor 3 to A-D conversion and sequentially reading them into the PCU 100. The output data of the units 102, 103 and 104 are transmitted to the CPU 100 via the common bus 123. Numeral 105 designates a memory unit storing the control program of the CPU 100 and having a function of storing the output data of the units 101, 102, 103 and 104, and the transmission of data between the memory unit 105 and the CPU 100 is effected via the common bus 123. Numeral 106 designates a digital output unit which gives the actual time point corresponding to the engine rotational angle (the crank angle) from digital signal data indicative of the time point of interrupting the current flow in the ignition coil 6, namely, the ignition timing computed by the CPU 100 and which also converts digital signal data indicative of the duration of opening of the fuel injection valves 4, namely, the fuel injection quantity computed by the CPU 100 to a pulse signal having a pulse time width representing the duration of opening of the fuel injection valves 4. Numeral 107 designates a driver circuit which amplifies the ignition control signal from the digital output unit 106 to supply a current flowing through the ignition coil 6 via a transistor 107*a* and then to interrupt the current flow in the ignition coil 6, thus determining the ignition timing. Numeral 108 designates a current amplifier which amplifiers the fuel control pulse signals from the digital output unit 106 and applies them to the fuel injection valves 4 to drive them.

As shown in FIG. 2, the rotational angle sensor 8 comprises three sensors 81, 82 and 83 such that the first rotational angle sensor 81 generates an angle signal A at a positon which is before the position of the angle 0° by the angle $\theta$° in terms of crank angle degrees once at every two revolutions of the engine crankshaft (or at every revolution of the distributor 7). The second rotational angle sensor 82 is designed to generate an angle signal B at a position of the angle $\theta$° before the position of the angle 360° in terms of crank angle degrees once at every two revolutions of the engine crankshaft. The third rotational angle sensor 83 is designed to generate the same number of angle signals as the number of engine cylinders at equal intervals for every revolution of the crankshaft, that is, six angle signals C for every crankshaft revolution at intervals of 60° from the position of the crank angle $\theta$° when a six cylinder engine is used as in the present embodiment.

The interruption unit 101 receives the angle signals (or the rotational angle signals) from the rotational angle sensors 81, 82 and 83 to generate signals for commanding interruption for the ignition timing processing and interruption for the fuel injection quantity processing. More specificially, the angle signals C from the third rotational angle sensor 81 are subjected to frequency division by 2 and an interrupt command signal D is generated just after the generation of the angle signal A from the first rotational angle sensor 81. This interrupt command signal D is generated six times for every two revolutions of the crankshaft, that is, as many times as the number of the engine cylinders for every two revolutions of the crankshaft. Thus, in the case of a six cylinder engine, the signal D is generated once at every 120° crankshaft rotation to command the interruption of the CPU 100 for the ignition timing processing. The interruption unit 101 also subjects the signals from the third rotational angle sensor 83 to frequency division by 6 and an interrupt command signal E is generated at every 360° (at every revolution) starting at the sixth signal from the third rotational angle sensor 83 or at 300° in terms of crank angle degrees after the generation of the angle signals from the first and second rotational angle sensors 81 and 82. This interrupt command signal E commands the interruption of the CPU 100 for the fuel injection quantity processing.

Numeral 120 designates a primary voltage detecting circuit for comparing the primary coil voltage of the ignition coil 6 with a predetermined value thereby to detect the occurrence of misfiring depending on whether an ignition signal has been generated, and the circuit generates a pulse signal when there occurs no misfiring. Numeral 121 designates a monostable pulse generator circuit for receiving the signal from the detecting circuit 120 to generate and supply a pulse signal to the latch circuit 110. When the ignition system is functioning normally without causing any misfiring, the latch circuit 110 is latched by a pulse signal from the latch circuit 110 and supplies a corresponding signal to the digital signal processing unit 103. Numeral 111 designates a latch clearer circuit which, in accordance with the command signal supplied from the CPU 100 upon each fuel injection processing, applies a latch clear signal to the latch circuit 110 to clear its latched state.

Figure 3:
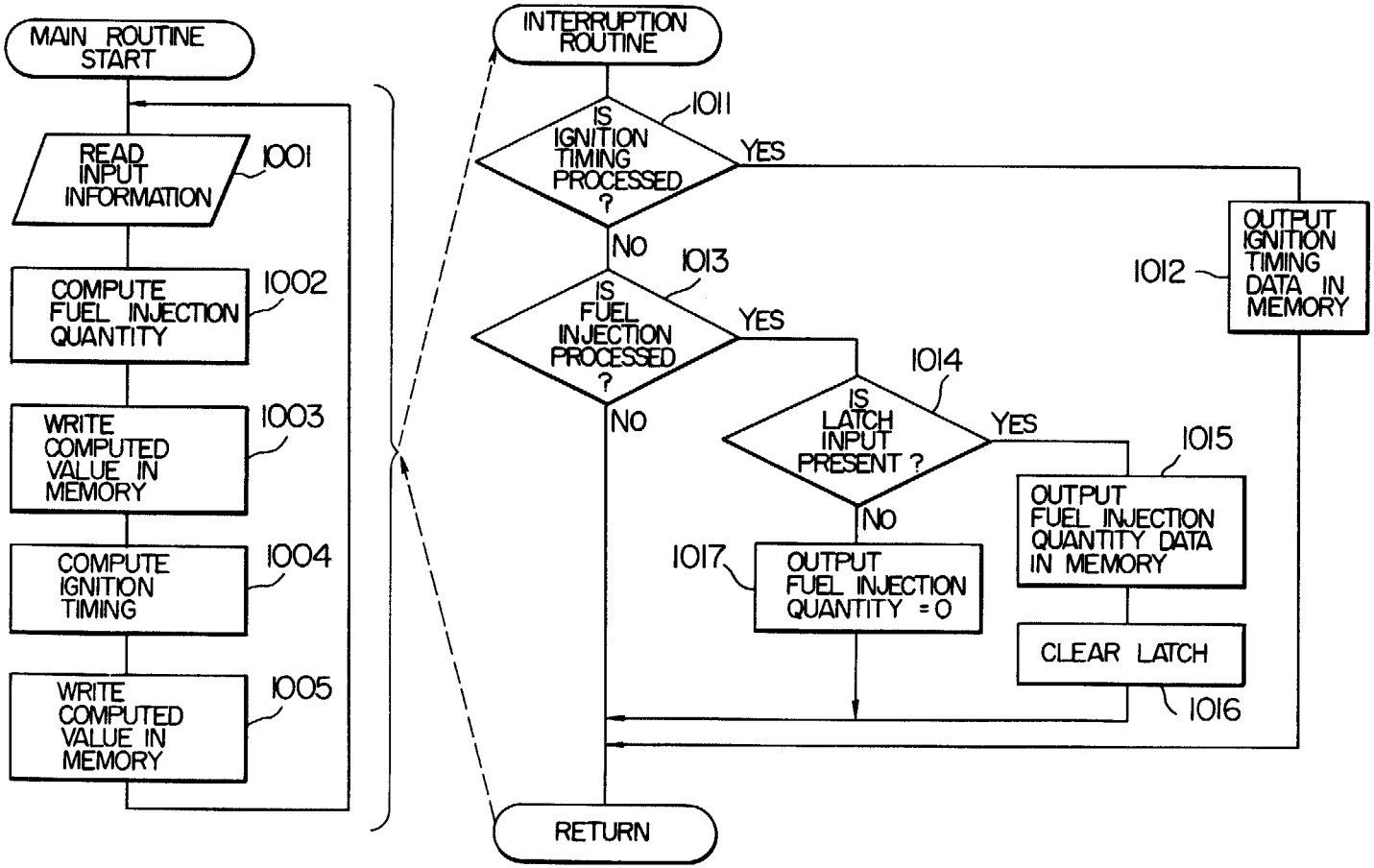
FIG. 3 is a schematic flow chart of the CPU shown in FIG. 2.

FIG. 3 illustrates a schematic flow chart of the CPU 100, and the operation and function of the CPU 100 will now be described with reference to the flow chart. When the engine is started, the main routine is started performing the processing of initialization which is not shown. Then, a step 1001 reads the input information, that is, the A-D conversion signals from the A-D conversion processing unit 104 which are indicative of the cooling water temperature, the atmospheric air temperature and the intake air quantity and the signals indicative of engine rotation from the engine rotation counting unit 102. A step 1002 computes the fuel injection quantity, namely, the injection time width of the injection valves on the basis of the input information, and the next step 1003 writes the computed value in the memory. Then, a step 1004 computes the ignition timing on the basis of the input information, and the next step 1005 writes the computed value in the memory.

When the ignition timing processing command signal E and the fuel injection processing command signal D are respectively applied to the CPU 100 from the interruption unit 101, the CPU 100 is immediately switched to the interrupt processing routine, even if the main routine is processed at the time. When the ignition timing interrupt processing command signal D is applied, the interrupt processing routine proceeds from a step 1011 to a step 1012 so that the computed ignition timing data stored in the memory unit 105 is read out and delivered to the digital output unit 106. When the fuel injection interrupt processing command signal E is applied, the interrupt processing routine proceeds from a step 1013 to a step 1014 which determines whether the latch circuit 110 has recieved a latch input, that is, whether the circuit has received a signal indicating the ignition has taken place normally. Thus, when the latch circuit 110 has received a latch input, namely, when the ignition has occurred normally, the processing proceeds to a step 1015. The step 1015 reads the computed fuel injection quantity data stored in the memory unit 105 and delivers it to the digital output unit 106. Then, a step 1016 applies a command to the latch clearer circuit 111 to clear the latch circuit 110. If the step 1014 determines that misfiring has occured in the ignition system, the latch circuit 110 does not receive a latch input and the processing proceeds to a step 1017, which outputs the data for reducing the fuel injection quantity to zero thereby to stop the fuel injection. After the above-described interrupt processing routine has been completed, the processing returns to the processing steps of the main routine which was interrupted previously.

In the above-described embodiment, if the ignition system is operating normally, a normal voltage is produced in the primary coil of the ignition coil 6 and the monostable pulse generator circuit 121 applies a pulse signal to the latch circuit 110. If misfiring occurs, no pulse signal is applied to the latch circuit 110 and the injection of fuel into the engine is stopped, thus preventing the occurrence of afterburning due to unburned gases or a rise in the temperature of the catalyst.

While, in the above-described embodiment, the detection of misfiring is effected by using a voltage in the primary coil of the ignition coil 6, the detection of misfiring can of course be accomplished by using an electric signal in the secondary coil.

It will thus be seen from the foregoing that in accordance with this invention there is provided a method in which the fuel injection quantity of a fuel injection system and the ignition timing of an ignition system of an engine are computed and controlled by a microcomputer in accordance with the operating conditions of the engine, and the feature of the method of this invention resides in determining the occurrence of misfiring by the use of an electric signal in the ignition coil of the ignition system such that if the result of the determination indicates the presence of misfiring, irrespective of the computed fuel injection quantity data, data is generated to reduce the fuel injection quantity to zero, thereby stopping the fuel injection. Thus, the present invention has a great advantage of preventing afterburning and a rise in the temperature of the catalyst from being caused by misfiring due to a failure in the ignition system.

We claim:

1. In a method of controlling fuel injection of an internal combustion engine in which a fuel injection quantity of a fuel injection system and ignition timing of an ignition system of said engine are computed, stored and controlled by a microcomputer including memory means by utilizing, as input signals thereto, signals indicative of operating conditions of said engine, the improvement comprising the steps of:

generating a discrimination signal indicative of the presence or absence of misfiring in accordance with an electric signal from said ignition system;

storing temporarily said discrimination signal in a temporary memory circuit;

reading said discrimination signal stored in said temporary memory circuit prior to the operation of said fuel injection system;

causing said microcomputer to output computed fuel injection quantity data stored in said memory means and then to clear said discrimination signal stored in said temporary memory circuit when said discrimination signal indicates that ignition has occurred, and causing said microcomputer to ignore said computed fuel injection quantity data stored in said memory means and to output zero fuel injection quantity data when said discrimination signal indicates that no ingition has occurred; and injecting a computed quantity of fuel from said fuel injection system in response to said computed fuel injection quantity data output from said microcomputer and stopping fuel injection from said fuel injection system in response to said zero fuel injection quantity data output from said microcomputer.

2. A method according to claim 1, wherein said discrimination signal generating step generates a high level discrimination signal when ignition occurs.

3. A method according to claim 1, wherein said temporary memory circuit comprises a latch circuit, and wherein said discrimination signal stored in said temporary memory circuit is cleared by a latch clearer circuit.

4. In a method of controlling fuel injection of an internal combustion engine in which a fuel injection quantity of a fuel injection system of said engine is computed, stored and controlled by a microcomputer having memory means by utilizing, as input signals thereto, signals indicative of operating conditions of said engine, the improvement comprising the steps of:

comparing an electric signal from a primary winding of an ignition coil of an ignition system of said engine with a predetermined reference signal to generate a discrimination signal indicative of the presence or absence of misfiring;

storing temporarily said discrimination signal in a temporary memory circuit;

reading said discrimination signal stored in said temporary memory circuit prior to the operation of said fuel injection system;

causing said microcomputer to output computed fuel injection quantity data stored in said memory means and then to clear said discrimination signal stored in said temporary memory circuit when said discrimination signal indicates that ignition has occurred, and causing said microcomputer to ignore said computed fuel injection quantity data stored in said memory means and to output zero fuel injection quantity data when said discrimination signal indicates that no ignition has occurred; and injecting a computed quantity of fuel from said fuel injection system in response to said computed fuel injection quantity data output from said microcomputer and stopping fuel injection from said fuel injection system in response to said zero fuel injection quantity data output from said microcomputer.

* * * * *